United States Patent [19]

Noble

[11] 4,059,267

[45] Nov. 22, 1977

[54] FOLLOW THROUGH INDICATOR FOR BOWLERS

[76] Inventor: Howard E. Noble, 30 Stoneleigh, Apt. 1, Buffalo, N.Y. 14223

[21] Appl. No.: 700,306

[22] Filed: June 28, 1976

[51] Int. Cl.[2] ..... A63B 71/06

[52] U.S. Cl. ..... 273/54 B; 273/183 B

[58] Field of Search ..... 273/54 B, 183 B, 186 A

[56] References Cited

U.S. PATENT DOCUMENTS

| | | | |
|---|---|---|---|
| 3,301,559 | 1/1967 | Jolley | 273/54 B |
| 3,336,679 | 8/1967 | Davis | 273/54 B X |

*Primary Examiner*—Anton O. Oechsle

*Attorney, Agent, or Firm*—Christel & Bean

[57] ABSTRACT

A follow through indicator for bowlers comprising a planar base element on a wristband for fastening to a bowler's arm, preferably adjacent the wrist, such that the base element is disposed in a plane parallel to the plane of the path of the bowler's arm during delivery and throw of the ball. An indicator element such as a pendulum bar is pivotally mounted on the base for movement from an initial rest position to a position indicating that a proper follow through has been made, the base serving to guide movement of the indicator along a path generally parallel to the path of the bowler's arm during delivery and throw of the ball. The device includes holding means such as magnets on the base element, in which case the pendulum is magnetically attractable, for holding the indicator element once it reaches the position indicating proper follow through, for convenience in inspection.

6 Claims, 6 Drawing Figures

FOLLOW THROUGH INDICATOR FOR BOWLERS

BACKGROUND OF THE INVENTION

This invention relates to the art of bowling apparatus, and more particularly to a new and improved form indicating device for bowlers.

One area of use of the present invention is in providing an individual bowler with an indication whether or not his delivery and throw of the ball has concluded with a proper follow through. Expert bowlers, including professionals and instructors, stress the importance of a firm wrist and follow through to maintain accuracy. It would, therefore, be highly desirable to provide a follow through indicator device which can be worn comfortably on the arm or wrist of a bowler which is effective in providing an indication whether the bowler has made the proper follow through and which at the same time does not interfere with the bowler's activity.

SUMMARY OF THE INVENTION

It is therefore a primary object of the present invention to provide a new and improved follow through indicator device for bowlers.

It is a further object of the present invention to provide such a follow through indicator device which is conveniently and comfortably worn on the arm adjacent the wrist of a bowler.

It is a further object of this invention to provide such a follow through indicator device, which does not interfere with the bowler's game activities.

It is a further object of this invention to provide such a follow through indicator device which is effective in indicating whether the bowler has made a proper follow through and which holds or maintains the indication for convenience in subsequent inspection.

It is a further object of this invention to provide such a follow through indicator device which is simple in construction so as to be easy to use and economical to manufacture.

The present invention provides a follow through indicator for bowlers comprising a generally planar base element and means for fastening the base element to a bowler's arm, preferably adjacent the wrist, such that the base element is disposed in a plane generally parallel to the plane of the path of the bowler's arm during delivery and throw of the ball. An indicator element is movably mounted on the base for movement from an initial or rest position to a position indicating that a proper follow through has been made, the base serving to guide movement of the indicator along a path generally parallel to the path of the bowler's arm during delivery and throw of the ball. The device includes means for holding the indicator element once it reaches the position indicating proper follow through for convenience in inspection. There can be more than one indicating position and corresponding holding means, for example a first to indicate that a minimum amount of follow through was made and a second to indicate that a preferred amount of follow through occurred.

The foregoing and additional advantages and characterizing features of the present invention will be clearly apparent upon a reading of the ensuing detailed description together with the included drawing wherein:

BRIEF DESCRIPTION OF THE DRAWING FIGURES

DETAILED DESCRIPTION OF THE ILLUSTRATED EMBODIMENT

Figure 1:
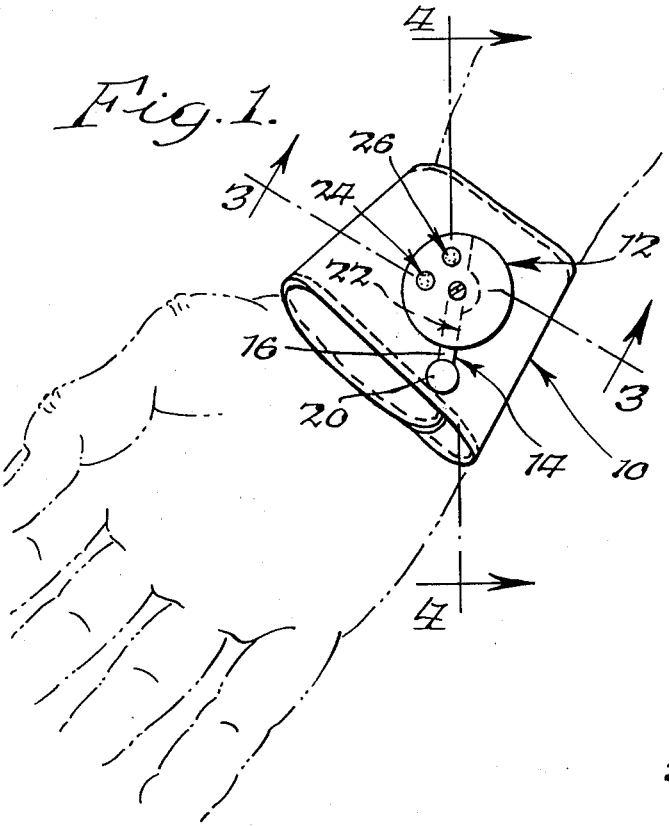
FIG. 1 is a perspective view of a follow through indicator device according to the present invention as it would appear in use on the arm adjacent the wrist of a bowler.
Figure 2:
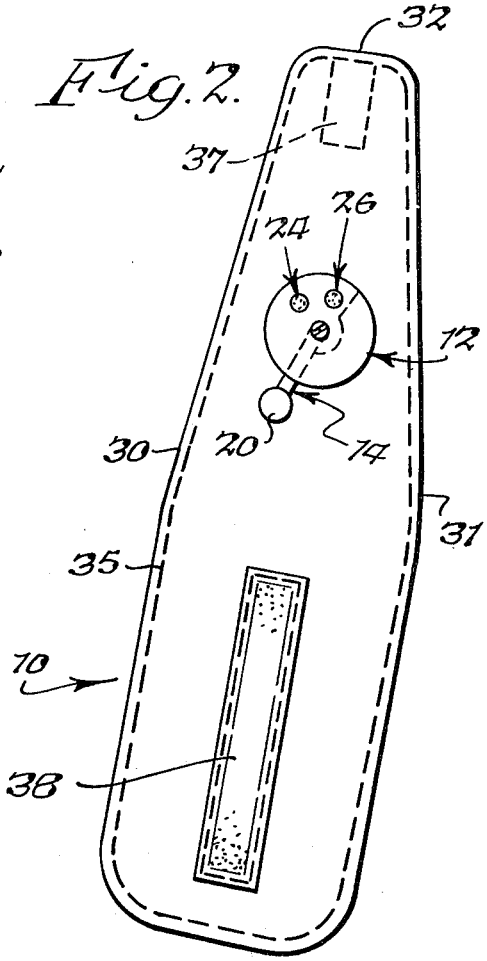
FIG. 2 is an elevational view of the follow through indicator device of FIG. 1 removed from the bowler's arm with the wrist band stretched out flat.

Referring now to FIGS. 1 and 2, the follow through indicator for bowlers according to the present invention comprises fastening means in the form of a strap generally designated 10 which is removably secured to the bowler's arm around the area of the wrist in a manner which will be described in further detail presently. A base element 12 is fixed to the outer surface of the strap 10, the base 12 preferably being generally disc-shaped. The apparatus further comprises an indicator element generally designated 14 which is movably mounted on base 12. In particular, the indicator element preferably is in the form of an elongated bar 16 pivotally mounted at one end to base 12 at the center of base 12 by means of a bolt 18 or the equivalent, and bar 16 is of a length such that it extends radially outwardly beyond the periphery of base 12 and terminates in a weight element 20. According to a preferred mode of the present invention, bar 16 is of magnetically attractable material such as nickel-plated steel, and base 12 of a non-magnetic material such as plastic.

The apparatus further comprises means for holding the indicator element 16 in an initial or rest position. In preferred form the holding means comprises an abutment or edge surface generally designated 22 in FIG. 1 and which will be described in detail further on in the specification. The apparatus further comprises means for catching and holding the indicator means 14 when the indicator has been caused to travel through a path, in particular an arcuate path, indicative of a proper amount of follow through. In preferred form the catching and holding means comprises first and second magnetic means generally designated 24 and 26, respectively, in FIG. 1. In particular, the first magnetic means is spaced around and along the circumference of base 12 a predetermined arcuate distance from the surface or abutment 22. This distance is selected in the present illustration to indicate a minimum amount of proper follow through as will be described in further detail presently. In other words, when the indicator element 14 is caused to move a sufficient distance to be held by the first magnetic means 24, this indicates that the aforementioned amount of follow through has taken place. The second magnetic means 26 is spaced a relatively smaller arcuate distance beyond the first magnetic means 24 such that when the preferred, proper degree of follow through has occurred, the indicator 14 will be held in position adjacent the second magnetic means.

Referring now to FIG. 2, a preferred form of strap 10 is generally rectangular in shape including first and second side edges 30, 31 which are generally parallel along approximately one-half the length of strap 10 and which converge slightly along the remainder of the length and meet a relatively short edge 32 at one end of the strap in relatively smooth or rounded corners. The edges 30, 31 meet a relatively longer edge 34 at the opposite end of strap 10 and at curved or rounded corners. The strap 10, which can be of leather or plastic material, can have stitching 35 around the periphery thereof either for mechanical reasons, such as if the strap is of laminated construction, or decorative purposes. Strap 10 is provided with a first fastening element 37 adjacent the end 32 and a second fastening element 38 positioned slightly beyond the mid point of the axial length of strap 10 and located in the wider portion thereof. The fastening elements 37, 38 are adapted to mate or releasably interconnect with each other. One form of fastening element is the loop and hook type fastener known in the art as Velchro. The fastener element 37 comprises a relatively short rectangular strip of Velchro material and the fastener 38 comprises a relatively longer strip of the same material, both strips being disposed generally parallel to the longitudinal axis and generally along the center line of the strap 10. The length of strip 38 permits adjustment and allows strap 10 to fit comfortably on various sizes of wrists.

Figure 3:
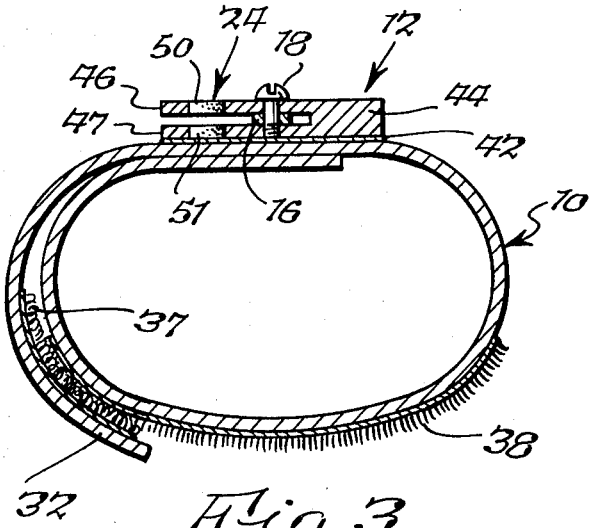
FIG. 3 is an enlarged sectional view taken about on line 3—3 of FIG. 1.
Figure 4:
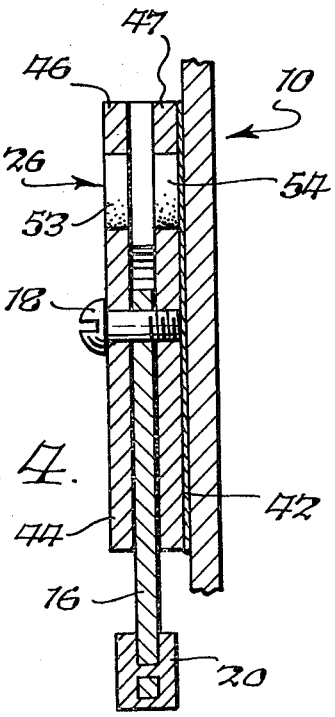
FIG. 4 is an enlarged fragmentary sectional view taken about on line 4—4 of FIG. 1.

Referring now to FIGS. 3 and 4, base 12 is fixed or secured in a suitable manner to the outer surface of strap 10, for example by means of a suitable adhesive material designated 42 in FIGS. 3 and 4. Base 12 preferably is of plastic material and is generally disc shaped including a main body portion 44 having a recess or open region therein extending through approximately half the area thereof defining a pair of spaced apart coplanar flange portions 46 and 47. As shown in FIG. 3, the first magnetic means 24 comprises a pair of permanent magnetic elements 50, 51 which are embedded or fixed in the flange portions 46 and 47, respectively. The magnets 50, 51 in the present illustration are solid and in the shape of small discs, being aligned such that the exposed faces thereof are in opposition across the air gap formed between the flange portions 46, 47. Similarly, the second magnetic means 26 comprises first and second permanent magnet elements 53 and 54, respectively fixed in the flange portions 46 and 47. The magnets 53 and 54 are positioned in the flange portions 46 and 47, respectively in a manner so as to be in alignment such that the exposed faces thereof in opposition across the air gap formed between the flanges 46, 47.

The width or thickness of the open interior region of base 12, i.e. the distance between the inner surface of the flange portions 46, 47, is sufficient to allow movement of indicator bar 16 therein. The extent or area of the open region is about one-half of the area of the circular base 12. The one end of bar 16 is pivotally connected to the screw 18 which, in turn, is connected to base 12 at the center thereof. The edge or stop abutment surface 22 is generally coincident with a radius extending from the center of the circular base 12. The open interior region extends in base 12 from surface 22 to another surface substantially diametrally opposed to surface 22 or, in other words, the region occupies approximately one-half the circular area of base 12. The indicator bar 16, located between the flange portions 46, 47, is movable about the pivot 18 along the air gap between portions 46, 47.

The device of the present invention is operated in the following manner. The indicator is fastened to a bowler's arm by means of strap 10 and, in particular, the bowler grasps the strap 10 with his other hand locating the base element 12 generally centrally of the forearm side of wrist and then wraps the strap 10 around the wrist, in particular one end up and over and then back and down over the back of the wrist area and the other end of strap 10 around and up along the back side of the wrist. At this point, the fastener element 32 adjacent the smaller end of strap 10 will be in proximity to fastener element 38 and the base element 12 will be located generally centrally of the forearm side of the wrist as shown in FIG. 1. The fastener elements 32 and 38 can be pushed into engagement thereby drawing strap 10 tightly around the bowler's wrist.

The illustration in FIGS. 1 and 2 of the location of disc 12 on strap 10 and the disposition of indicator element 16 and stop surface 22 is for a right-handed bowler. For a left-handed bowler, the orientation of disc 12 on strap 10 is such that the location of magnets 24, 26, stop surface 22 and indicator bar 16 would be reversed. In particular, bar 16 would be movable about pivot 18 in a counterclockwise direction from stop 22 toward magnets 24, 26 as viewed in FIG. 2.

Figure 5:
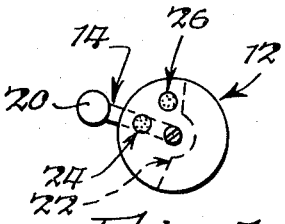
FIG. 5 is an elevational view with parts removed showing the device of FIG. 1 at one stage of the operation thereof.

In operation, as the bowler prepares to approach, the ball is held forward with the hand to which the indicator device is attached, and the indicator element 16 rests against stop abutment 22 with bar 16 in a generally vertical direction with the weighted end 20 pointing toward the floor approximately as shown in FIG. 1. As the bowler begins his back swing with the arm holding the ball, indicator element 16 begins to move away from surface 22 in a forward or clockwise direction about the pivot 18, i.e. in the direction of the bowling pins. Upon completion of the back swing and during the forward throw, the forward movement of indicator bar 16 increases in a clockwise direction about pivot 18. After release of the ball, if the bowler fails to follow through, the forward movement of indicator bar 16 ceases before it reaches the first magnetic means 24 and the bar 16 moves about pivot 18 in a backward or counter clockwise direction and returns to its initial position contacting surface 22. This gives a visible indication to the bowler that he did not follow through properly. If after release of the ball the bowler makes a minimum follow through, such as by bringing his arm up to a generally horizontal position at about shoulder level, this imparts sufficient forward or clockwise motion to indicator bar 16 to move it into proximity with the first magnetic means 24. The magnetically attractable bar 16 is held by magnetic attraction between the magnets 50 and 51 as illustrated in FIG. 5. This gives a visible indication to the bowler that he made at least a minimum follow through, and indicator 16 will remain held between magnets 50, 51 until moved away such as by hand whereupon it returns to the rest position contacting surface 22. The first magnetic means 24 comprising the opposed magnets 50, 51 is spaced from surface 22 about one quadrant of a circle, i.e. the arcuate or angular distance travelled by bar 16 from the initial or rest position to the position in the air gap between magnets 50, 51 is about 90°.

Figure 6:
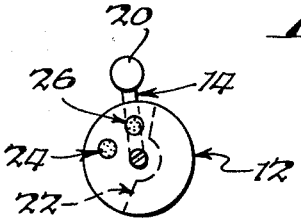
FIG. 6 is an elevational view with parts removed showing the device of FIG. 1 at another stage of the operation thereof.

If after release of the ball the bowler makes a preferred proper follow through; such as by bringing his arm up to a position above the horizontal at shoulder level and preferably to an angle of about 45° with respect to the horizontal, this imparts sufficient forward or clockwise motion to indicator bar 16 to move it through and beyond the magnets 50, 51 and into proximity with the second magnetic means 26. The magnetically attractable bar 16 then is held by magnetic attraction between the magnets 53, 54 as illustrated in FIG. 6. This gives a visible indication to the bowler that he made the preferred amount of follow through, and indicator 16 will remain held between magnets 53, 54 until moved away such as by hand whereupon it returns to the initial or rest position contacting surface 22. The second magnetic means 26 comprising the opposed magnets 53, 54 is spaced from surface 22 approximately slightly less than about one half of a circle, i.e. the arcuate or angular distance travelled by bar 16 from the initial or rest position to the position in the air gap between magnets 53, 54 is approximately less than 180° and in the neighborhood of about 135°.

The foregoing operation is similar when the device is used by a left-handed bowler, the device being attached to the bowler's left arm adjacent the wrist in the manner previously described. When worn on the left arm of a bowler, forward movement of indicator bar 16 is in a counterclockwise direction.

The small weight element 20, which can be of lead or similar material, serves to augment the pendulum-like movement of indicator bar 16 about pivot 18. The width and tightness of the band 10 serves to maintain a stiff and straight or in-line position of the bowler's hand, wrist and forearm during delivery of the ball. The material of disc 12 is of course non-magnetic so as to insure a sharpness of the magnetic fields in the localized regions of the air gaps between the magnets 50 and 51 and between the magnets 53 and 54. This in turn, provides a proper degree of sensitivity and accuracy of the indicator.

By way of example, in an illustrative device according to the present invention, the overall length of wrist band 10 can be about 10½ inches, the width adjacent end 32 about 1¾ inches, and the width adjacent end 34 about 2¾ inches. Disc 12 can have a diameter of about 1⅜ inches and an overall thickness of about ¼ inch. The indicator element can have an overall length of about 1⅜ inches measured from the end of bar 16 adjacent pivot 18 to the outer end of weight 20, the width of bar 16 being about 3/16 inch. Each of the magnets can have a diameter of about ¼ inch.

While the arrangement of the present invention including the spaced apart first and second magnetic means 24 and 26, respectively, is preferred other forms of guiding and holding means can be employed. For example, a relatively planar disc element could be provided with an indicator element similar to bar 16 and weight 20 pivotally connected to the disc at the center thereof. The disc would be provided with a stop abutment similar to edge surface 22. Extending in a clockwise direction from surface 22 there could be provided a gradually rising surface along and around the periphery of the disc, rising gradually upwardly from the planar surface of the disc and terminating at a location generally the same as the location of the first magnetic means 24 in the embodiment of FIGS. 1–6. This rising surface portion could be relatively narrow in width and generally arcuate along the length thereof. The termination preferably would be a surface which would meet the planar surface of the disc at about a right angle thereby defining a shoulder. The indicator bar then would be movable from a rest position against the stop surface similar to surface 22 along and over the rising surface portion. If the bowler makes sufficient follow through, the indicator will travel a sufficient distance to move along the entire rising surface and then drop into the shoulder at the end thereof, being held there to provide an indication of proper follow through. By way of example, the surface could rise to a maximum height of about 3/32 inch. The shoulder could be provided with an undercut to effectively hold the indicator bar.

It is therefore apparent that the present invention accomplishes its intended objects. While a single embodiment of the present invention is described in detail, this is for the purpose of illustration, not limitation.

I claim:

1. A follow through indicator for bowlers comprising:

a. a generally planar base element;

b. means for fastening said base element to the arm of a bowler in a manner such that said base element is in a plane generally parallel to the path through which the bowler's arm will move during delivery and throw of the ball;

c. an indicator element movably mounted on said base for movement in a direction against the force of gravity from an initial or rest position to a position indicating that a proper follow through has been made;

d. said base element having means for guiding said indicator element for movement along a path generally parallel to the path through which the bowler's arm will move during delivery and throw of the ball; and e. holding means for holding said indicator element in said position indicating proper follow through is reached for maintaining the indication for visual inspection by the bowler.

2. Apparatus according to claim 1, wherein said indicator element is of magnetically attractable material and said holding means comprises magnet means for holding said indicator when in proximity thereto.

3. A follow through indicator for bowlers comprising:

a. a generally planar base element;

b. means for fastening said base element to the arm of a bowler in a manner such that said base element is in a plane generally parallel to the path through which the bowler's arm will move during delivery and throw of the ball;

c. an indicator element movably mounted on said base for movement from an initial or rest position to a position indicating that a proper follow through has been made, said indicator element being elongated and pendulum-like and being pivotally connected at one end to said base element;

d. said base element having means for guiding said indicator element for movement along a path generally parallel to the path through which the bowler's arm will move during delivery and throw of the ball; and e. holding means for holding said indicator element in said position indicating proper follow through is reached for maintaining the indication for visual inspection by the bowler.

4. A follow through indicator for bowlers comprising:

a. a generally planar base element;

b. means for fastening said base element to the arm of a bowler in a manner such that said base element is in a plane generally parallel to the path through which the bowler's arm will move during delivery and throw of the ball;

c. an indicator element movably mounted on said base for movement from an initial or rest position to a position indicating that a proper follow through has been made, said indicator element being pivotally connected at one end to said base element and movable through an arc from an abutment defining said initial position toward said holding means;

d. said base element having means for guiding said indicator element for movement along a path generally parallel to the path through which the bowler's arm will move during delivery and throw of the ball; and e. holding means for holding said indicator element in said position indicating proper follow through is reached for maintaining the indication for visual inspection by the bowler, said holding means being spaced from said initial position along an arcuate path.

5. A follow through indicator for bowlers comprising:

a. a generally planar base element;

b. means for fastening said base element to the arm of a bowler in a manner such that said base element is in a plane generally parallel to the path through which the bowler's arm will move during delivery and throw of the ball;

c. an indicator element movably mounted on said base for movement from an initial or rest position to a position indicating that a proper follow through has been made, said indicator element being of magnetically attractable material, being elongated, and being pivotally connected at one end to said base element;

d. said base element having means for guiding said indicator element for movement along a path generally parallel to the path through which the bowler's arm will move during delivery and throw of the ball; and e. holding means for holding said indicator element in said position indicating proper follow through is reached for maintaining the indication for visual inspection by the bowler, said holding means comprising magnet means spaced from said initial position along an arcuate path.

6. Apparatus according to claim 5, wherein said magnet means comprises first magnet means arcuately spaced from said initial position a distance corresponding to a minimum proper follow through made by the bowler and second magnet means spaced beyond said first magnet means and spaced from said initial position a distance corresponding to a preferred proper follow through by the bowler.

* * * * *